US008579168B2

(12) United States Patent
Zack et al.

(10) Patent No.: US 8,579,168 B2
(45) Date of Patent: Nov. 12, 2013

(54) MULTIFUNCTION INFANT CARRIER WITH LUMBAR BELT

(75) Inventors: Elizabeth Zack, Brooklyn, NY (US); Sara Lighthall, San Diego, CA (US)

(73) Assignee: Infantino, LLC., San Diego, CA (US)

( * ) Notice: Subject to any disclaimer, the term of this patent is extended or adjusted under 35 U.S.C. 154(b) by 0 days.

(21) Appl. No.: 13/439,700

(22) Filed: Apr. 4, 2012

(65) Prior Publication Data

US 2012/0318833 A1 Dec. 20, 2012

Related U.S. Application Data

(63) Continuation-in-part of application No. 13/069,832, filed on Mar. 23, 2011.

(51) Int. Cl.
*A47D 13/02* (2006.01)

(52) U.S. Cl.
USPC ..... 224/160; 224/159; 224/576; 2/49.1

(58) Field of Classification Search
USPC ..... 224/159, 160, 161, 576, 262, 600, 275; 2/49.1–3; 297/465; 150/154
See application file for complete search history.

(56) References Cited

U.S. PATENT DOCUMENTS

| | | | | |
|---|---|---|---|---|
| 3,780,919 | A | 12/1973 | Hansson | |
| 4,318,502 | A | 3/1982 | Lowe | |
| 4,333,591 | A | 6/1982 | Case | |
| D266,800 | S | 11/1982 | Kula et al. | |
| 4,469,259 | A | 9/1984 | Krich et al. | |
| 4,579,264 | A * | 4/1986 | Napolitano | 224/160 |
| 4,986,458 | A | 1/1991 | Linday | |
| 5,071,047 | A * | 12/1991 | Cordisco | 224/158 |
| 5,178,309 | A | 1/1993 | Bicheler et al. | |
| 5,246,152 | A | 9/1993 | Dotseth | |
| 5,361,952 | A | 11/1994 | Gold | |
| D388,247 | S | 12/1997 | McLauchlan | |
| 5,772,088 | A | 6/1998 | Nelson | |
| 5,791,535 | A | 8/1998 | Roan et al. | |
| 5,802,610 | A * | 9/1998 | Burr | 2/49.4 |

(Continued)

FOREIGN PATENT DOCUMENTS

JP 2006271859 10/2006

OTHER PUBLICATIONS

PCT Search Report and Written Opinion for PCT/US2012029289 issued on Jun. 8, 2012.

*Primary Examiner* — Nathan J Newhouse
*Assistant Examiner* — Phillip Schmidt
(74) *Attorney, Agent, or Firm* — Stetina Brunda Garred & Brucker

(57) ABSTRACT

There is provided is an infant carrier having a lumbar belt to enhance the comfort and support during usage thereof. The infant carrier is adaptable to support an infant in a forward facing position or a rearward facing position. The infant carrier may also be configured to allow for easy adjustment to fit the infant carrier to the specific size of the wearer. The infant carrier may also be configured to be connectable with a bib in a variety of configurations to protect the wearer or infant carrier from fluids or objects which may fall from the infant's mouth. The bib may also be connected to the infant carrier in a position to provide shade to the infant. In this regard, the bib may provide three-in-one functionality to the infant carrier to enhance the overall experience of wearing the carrier for both the wearer and the infant.

17 Claims, 7 Drawing Sheets

(56) References Cited

U.S. PATENT DOCUMENTS

| | | | | |
|---|---|---|---|---|
| 5,813,580 | A | 9/1998 | Fair | |
| 5,848,741 | A * | 12/1998 | Fair | 224/160 |
| 5,934,528 | A | 8/1999 | Higuchi | |
| 6,179,175 | B1 | 1/2001 | Painter | |
| 6,182,873 | B1 * | 2/2001 | Christopher et al. | 224/159 |
| 6,186,381 | B1 | 2/2001 | Kernkamp | |
| 6,409,060 | B2 | 6/2002 | Donine | |
| 6,520,391 | B2 | 2/2003 | Yen | |
| 6,598,771 | B2 * | 7/2003 | Norman | 224/160 |
| 6,763,983 | B2 | 7/2004 | Norman | |
| 7,070,076 | B2 | 7/2006 | Bergkvist | |
| 7,168,600 | B2 | 1/2007 | Hwang | |
| 7,269,858 | B2 * | 9/2007 | Rothschild | 2/49.4 |
| 7,512,993 | B1 * | 4/2009 | Gutierrez | 2/49.1 |
| 8,172,116 | B1 * | 5/2012 | Lehan et al. | 224/160 |
| 2002/0175194 | A1 | 11/2002 | Norman | |
| 2004/0149790 | A1 | 8/2004 | Kassai et al. | |
| 2005/0155996 | A1 | 7/2005 | Hiscocks | |
| 2005/0242136 | A1 * | 11/2005 | Moriguchi et al. | 224/160 |
| 2006/0113337 | A1 | 6/2006 | Yoshie | |
| 2006/0130220 | A1 | 6/2006 | Morgan | |
| 2007/0029356 | A1 | 2/2007 | Moriguchi et al. | |
| 2008/0087694 | A1 * | 4/2008 | Meng et al. | 224/160 |
| 2008/0283559 | A1 * | 11/2008 | Parness et al. | 224/159 |
| 2010/0072236 | A1 * | 3/2010 | Parness et al. | 224/161 |
| 2011/0101051 | A1 * | 5/2011 | Parness et al. | 224/160 |

* cited by examiner

MULTIFUNCTION INFANT CARRIER WITH LUMBAR BELT

CROSS-REFERENCE TO RELATED APPLICATIONS

The present application is a continuation-in-part application of U.S. patent application Ser. No. 13/069,832 entitled MULTIFUNCTION INFANT CARRIER filed Mar. 23, 2011.

STATEMENT RE: FEDERALLY SPONSORED RESEARCH/DEVELOPMENT

Not Applicable

BACKGROUND OF THE INVENTION

1. Field of the Invention

The present invention relates generally to carriers adapted to be worn by an adult in order to support and carry an infant or young child. More particularly, the present invention is directed to an infant carrier having a bib attachment which is adapted to be disposed in a conventional bib position or in a sun-visor position to provide shade for the infant.

2. Description of the Related Art

As is well known to parents of infants or young children, shoulder-supported infant carriers are extremely popular and commonly used to transport an infant or young child. Shoulder supported infant carriers as currently known in the art come in a wide range of designs and styles. A common attribute of these carriers is that they offer "hands free" operation, and allow the adult wearer to carry the infant while performing other activities. One currently known infant carrier is a frame-type carrier which typically supports the infant on the back of the wearer. Currently more popular than frame-type carriers are frameless or soft-sided carriers which typically support the infant on the front or chest of the adult wearer. In this regard, the soft-sided carriers allow for more interaction between the wearer and child.

Though soft-sided carriers provide certain advantages, they oftentimes possess certain deficiencies which detract from their overall utility. One such deficiency lies in the absence of a structure which protects the wearer or carrier from oral discharge (i.e., vomit, drool, etc.) from the infant. This deficiency is magnified by the fact that when the child is placed within the carrier, the wearer tends to move and be active, which may increase the likelihood that the infant will vomit, especially shortly after a meal.

Another deficiency lies in the absence of a structure which provides shade for the infant during use. Shortly after birth, young children tend to have sensitive skin, which may easily burn or be damaged by direct exposure to sunlight. As such, conventional infant carriers may leave the infant at risk of suffering from sunburn.

A further deficiency relates to the adaptability of the infant carrier to accommodate the specific size of the wearer. It is understood that the infant carrier may be used by a wide range of infant care providers (i.e., mother, father, grandparents, aunts, uncles, friends, etc.). As such, it is desirable that the infant carrier be easily adaptable to conform to the size of the various infant care providers which may wear the infant carrier.

The present invention addresses and overcomes these deficiencies by providing an infant carrier which is easily adaptable to fit snuggly on a wearer, wherein the infant carrier includes a bib which may be oriented in a conventional bib position to protect the wearer and infant carrier from oral discharge from the infant, as well as a sun-shade position to provide shade to the infant. These and other advantages attendant to the present invention will be described in more detail below.

BRIEF SUMMARY OF THE INVENTION

In accordance with the present invention, there is provided an infant carrier adaptable to support an infant in a forward facing position or a rearward facing position. The infant carrier is also configured to allow for easy adjustment to fit the infant carrier to the specific size of the wearer. The infant carrier is additionally configured to be connectable with a bib in a variety of configurations to protect the wearer or infant carrier from fluids or objects which may fall from the infant's mouth. The bib may also be connected to the infant carrier in a position to provide shade to the infant. In this regard, the bib may provide three-in-one functionality to the infant carrier to enhance the overall experience of wearing the carrier for both the wearer and the infant.

According to one implementation, the infant carrier includes a pair of shoulder straps and a main panel engageable with the pair of shoulder straps to define a pair of leg openings to receive and support the infant within the infant carrier. The bib includes a pair of attachment tabs and a bib panel connected to the pair of attachment tabs, the pair of attachment tabs being configured to be releasably attachable to the infant carrier.

The bib may be disposed in a first bib configuration by connecting the attachment tabs to a respective shoulder strap to dispose the bib panel between the pair of shoulder straps. The bib may be deployed in the first bib configuration when the infant is in the rearward facing position.

The bib may be disposed in a second bib configuration by connecting the attachment tabs to connecting straps formed on the main panel of the infant carrier, such that the bib panel extends from a body portion to a distal portion of the main panel when the infant carrier is in the forward facing position.

The bib may be disposed in a sun-visor configuration when the infant carrier is in the rearward facing position with the main panel extending above the infant's head. The distal portion of the bib is connected to the main panel and the attachment tabs are connected to the shoulder straps to deploy the bib over the infant to provide shade to the infant.

The bib and infant carrier may be configured to allow a wearer to easily switch the position of the bib between the first bib configuration, second bib configuration and the sun visor configuration.

The pair of shoulder straps may be connected to the main panel to assume an overlapping, intersecting configuration to define an intersection point. The infant carrier may additionally include a strap connector coupled to the straps and slidable along the straps to adjust the location of the intersection point to more comfortably fit the wearer.

It is also contemplated that the infant carrier may include a lumbar belt connected to the main body. The lumbar belt may include a first connector end and a second connector end engageable to each other to maintain a looped configuration about the abdomen and back of the wearer. A lumbar support pad may be affixed to the lumbar belt and may be slidably engaged to the main panel. The lumbar support pad may include a straight middle portion, and opposed outer portions angled relative to the middle portion to conform to the back of the wearer. The lumbar belt may be defined by a first segment to which the lumbar support pad is affixed, and a second segment having a first end coupled to the first segment with a threaded adjustable buckle and a second end coupled to the first segment with a locking connector. A tubular abdomen support sleeve may be selectively positionable along the second segment of the support belt between the first end and the second end thereof. The tubular abdomen support sleeve may be sized and configured for slidable engagement within the lateral sleeve of the anterior support panel.

It is further contemplated that each shoulder strap may include a shoulder engagement segment configured to be positionable adjacent a respective one of the wearer's shoulders to cup the respective one of the wearer's shoulders. Each shoulder engagement segment may include first and second lateral edges which are moveable relative to each other to provide adjustable coverage over the wearer's shoulders.

The present invention is best understood by reference to the following detailed description when read in conjunction with the accompanying drawings.

BRIEF DESCRIPTION OF THE DRAWINGS

These, as well as other features of the present invention, will become more apparent upon reference to the drawings wherein.

Common reference numerals are used throughout the drawings and detailed description to indicate like elements.

DETAILED DESCRIPTION OF THE INVENTION

Figure 1:
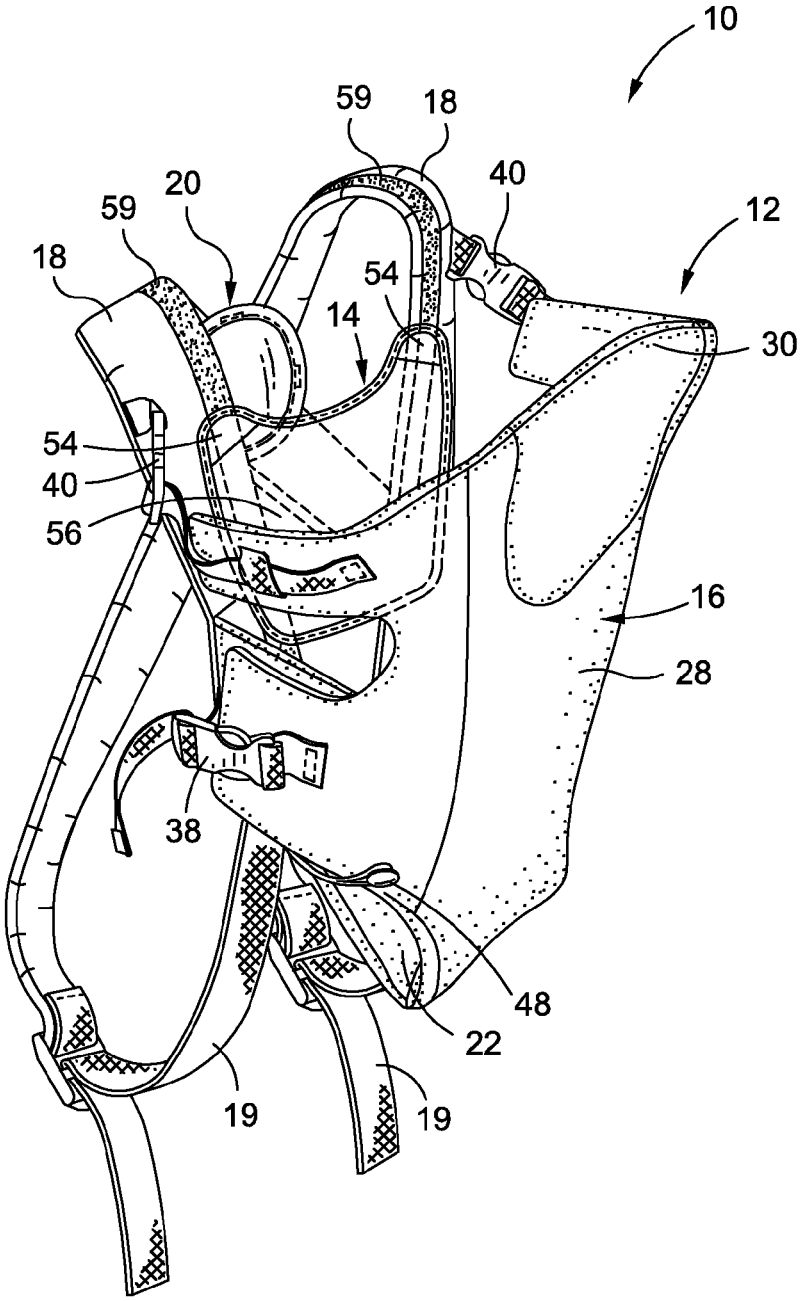
FIG. 1 is a upper perspective view of an infant carrier assembly including an infant carrier and a bib disposed in a first configuration for an infant seated in the infant carrier in a facing-in position.

Referring now to the drawings wherein the showings are for purposes of illustrating a preferred embodiment of the present invention only, and not for purposes of limiting the same, there is depicted an infant carrier assembly 10 which is specifically adapted to be worn by a wearer to support an infant or young child. The infant carrier assembly 10 includes an infant carrier 12 and a bib 14 detachably engageable with the infant carrier 12. The infant carrier 12 generally includes a main panel 16 and a pair of shoulder straps 18 connected to the main panel 16 to allow a wearer to dispose the infant carrier 12 over the wearer's shoulder to position the main panel 16 in front of the wearer's chest. The infant carrier 12 may include a strap adjuster 20 to adjust the size of the shoulder straps 18 to adapt the carrier 12 to the specific size of the wearer. The infant carrier 12 may also include a pocket 22 to capture fasteners or buckles connecting the straps 18 to the main body 16. The pocket 22 may contain the fasteners or buckles to provide more comfort to the lower abdominal area of the wearer. The bib 14 may be connected to the infant carrier 12 in several different positions to serve a number of different purposes. For instance, the bib 14 may be connected to the infant carrier 12 to serve as a conventional bib to protect the wearer and/or the infant carrier 12 from fluids or objects which may fall from the infant's mouth (see FIGS. 1, 7, and 8). It is additionally contemplated that the bib 14 may be connected to the infant carrier 12 for use as a sun visor to provide shade to the infant (see FIGS. 9 and 10). As such, a single bib 14 may be deployed in all of the above-described configurations to enhance the usage of the infant carrier 12.

Turning now to the specific structural features of the infant carrier 12, the main panel 16 of the infant carrier 12 includes an inner surface and an opposing outer surface. The main panel 16 defines a body portion 28 and a distal portion 30 foldable relative to the body portion 28 to adapt the infant carrier 12 from a facing-in configuration to a facing-out configuration. The main panel 16 may be comprised of a medial section and a pair of opposing lateral sections disposed on opposing sides of the medial section. The medial section and lateral sections collectively define a cradling support structure to support an infant adjacent the chest of the wearer. The main panel 16 may preferably be filled with a padded material to comfortably cradle the infant within the carrier 12.

A pocket 22 is connected to the main panel 16 opposite the distal portion 30. The pocket 22 is sized and configured to capture buckles or connectors used to connect the main panel 16 to the shoulder straps 18, as described in more detail below. The pocket 22 covers the buckles so the buckles do not painfully rub against the wearer's abdomen.

The main panel 16 is configured to be detachably engageable with the pair of shoulder straps 18. The shoulder straps 18 allow the wearer to transfer the collective load of the carrier 12 and the infant to the wearer's shoulders, similar to a conventional backpack. Along these lines, the straps 18 preferably include a padded material to ease the load on the wearer. The straps 18 include a length adjusting portion 19 to allow the wearer to adjust the overall length of the strap 18 to adjust the strap 18 to comfortably fit the wearer. The length adjusting portion 19 is preferably formed of woven nylon, or similar materials known by those skilled in the art, which are durable and allow for easy length adjustment of the strap 18.

Figure 3:
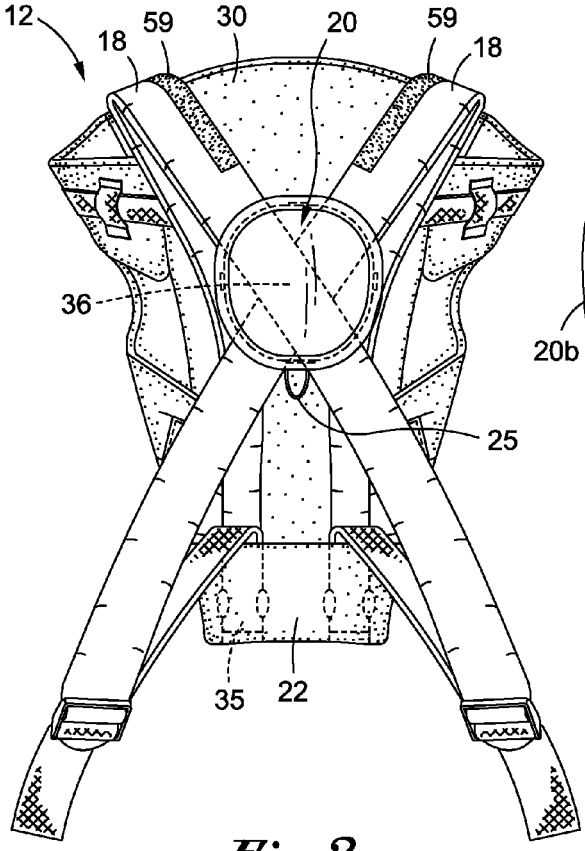
FIG. 3 is a rear view of the infant carrier depicted in FIG. 2.

The shoulder straps 18 and main panel 16 may include a plurality of complimentary fasteners/connectors to facilitate connection therebetween. In the embodiment depicted in the drawings, the main panel 16 and straps 18 are connected via a pair of first connectors 35 (captured by the pocket 22; shown in phantom in FIG. 3), a pair of second connectors 38, and a pair of third connectors 40. Each pair of connectors 35, 38, 40 may include a set of complimentary male and female buckle halves which are cooperatively engageable with each other.

In order to easily place the infant within the carrier 12, one of the pair of second connectors 38 and one of the pair of third connectors 40 may be disconnected to open up one side of the carrier 12. Once the infant is placed within the carrier 12, the disconnected second connectors 38 and third connectors 40 may be reconnected to secure the infant within the carrier 12. Since only one side of the carrier 12 needs to be opened when placing or removing an infant from the carrier 12, certain embodiments may include a first connector 35, second connector 38 and third connector 40 disposed on a common side of the infant carrier 12, with the opposing side of the infant carrier 12 having a more permanent attachment between the shoulder straps 18 and the main panel 16, such as being sewn together.

The shoulder straps 18 are disposed in an intersecting and overlapping configuration (see FIG. 3) to define an intersection point 36 where the straps 18 overlap each other. The strap adjuster 20 is connected to the straps 18 such that the intersection point 36 is disposed within the strap adjuster 20. The strap adjuster 20 may include two halves 20*a*, 20*b* (see FIG. 3) which are sewn together or otherwise fastened to define four openings through which the shoulder straps 18 pass through. One or both of the strap adjuster halves 20*a*, 20*b* may include a padded material disposed therein to rest comfortably adjacent the wearer's back. The strap adjuster 20 is configured to be slidable along the straps 18 to adjust the position of the shoulder straps 18, and more specifically, the position of the intersection point 36 relative to the wearer's back for a more comfortable fit for the wearer. By moving the intersection point 36, the wearer may adjust the load distribution to mitigate muscle soreness or fatigue while wearing the carrier 12. A loop 25 (see FIG. 3) may be connected to the strap adjuster 20 to allow a user to easily grab the adjuster 20 for moving the adjuster 20 along the straps 18.

Figure 2:
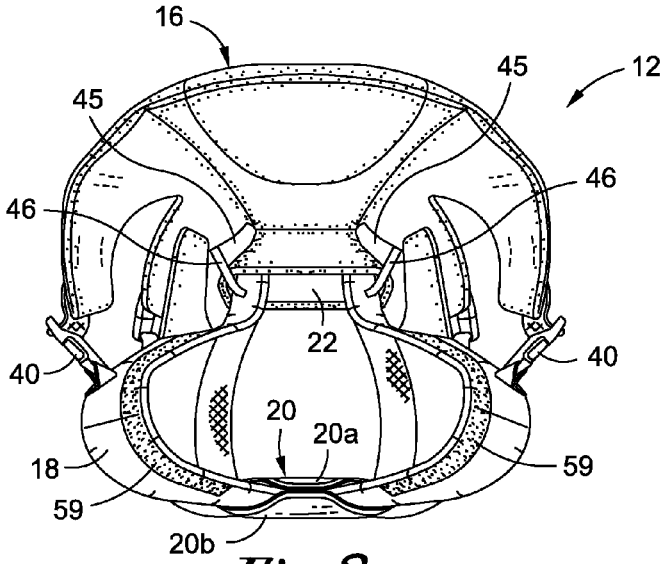
FIG. 2 is a top view of an embodiment of the infant carrier.
Figure 4:
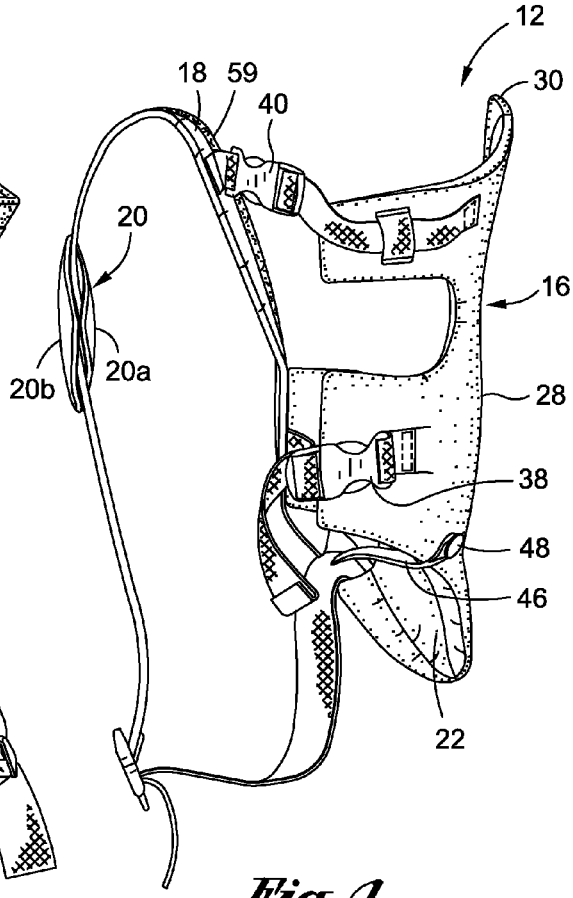
FIG. 4 is a side view of the infant carrier depicted in FIGS. 2-3.
Figure 5:
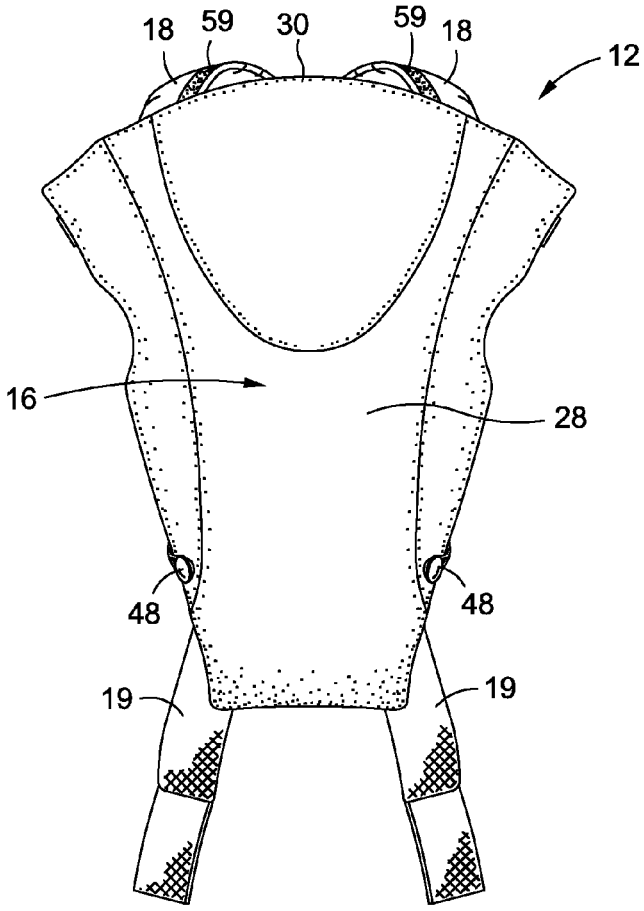
FIG. 5 is a front view of the infant carrier depicted in FIGS. 2-4.
Figure 6:
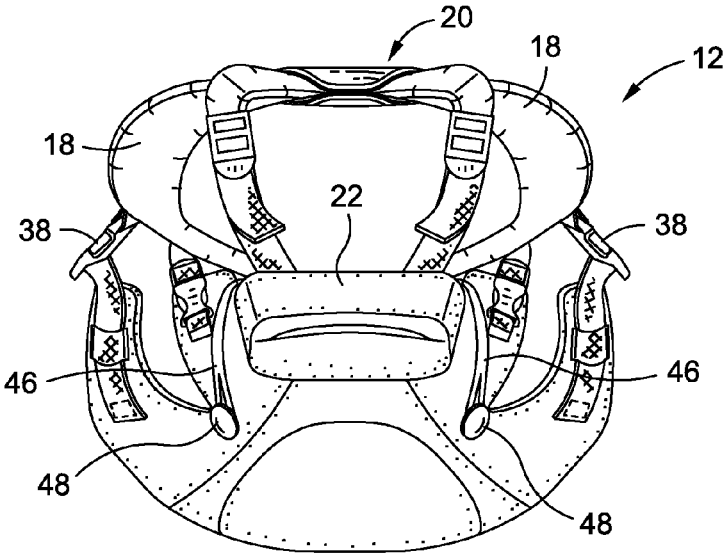
FIG. 6 is a bottom view of the infant carrier depicted in FIGS. 2-5.

The infant carrier 12 defines leg openings 45 (see FIG. 2) through which an infant's legs may pass through when the infant is placed within the carrier 12. Along these lines, the leg opening 45 defined by the infant carrier 12 may be too large for smaller infants, allowing the smaller infants to fall out of the carrier 12 through the leg openings. Accordingly, the carrier 12 may include leg straps 46 (see FIGS. 2 and 4) extending between the shoulder straps 18 and the main body 16 to decrease the size of the leg opening 45 to make it safe for use with smaller infants. The leg straps 46 include a slot configured to receive a button 48 (see FIG. 4) disposed on the main panel 16. As the infant becomes bigger, use of the leg straps 46 may not be necessary to ensure the infant is safely secured within the carrier 12.

The infant carrier 12 may be adaptable to support an infant in at least two different positions: (1) a facing-out position (i.e., forward position) or (2) a facing-in position (i.e., a rearward position). When the infant is relatively young, the infant may not have developed the strength and coordination to independently support his head. Therefore, it may be suitable to place the infant in the facing-in position wherein the distal portion 30 is disposed in a rearward configuration to provide support behind the infant's head. In the rearward configuration, the distal portion 30 is substantially coplanar with the body portion 28 (see FIG. 1) and extends behind the infant's head to provide support behind the infant, while the wearer's chest provides frontal support to the infant's head. In the rearward configuration, the pair of third connectors 40 are engaged to maintain the distal portion 30 in the rearward configuration. In other words, the third connectors 40 connect the distal portion 30 to the straps 18 to maintain the distal portion 30 in a coplanar position relative to the body portion 28.

As the child grows older and gains the strength and coordination to support his own head, the child may prefer to face out when placed in the carrier 12. Therefore, the main panel 16 is configured to transition between the rearward configuration to a forward configuration by disconnecting the pair of third connectors 40, and folding the distal portion 30 relative to the body portion 28 to dispose the distal portion 30 in an overlapping position relative to the body portion 28 (see FIG. 8). Therefore, when the child is placed in the carrier 12 in the facing-out position, the infant may be able to see in front of the carrier 12.

The following discussion now focuses on the use of the bib 14, which may be connected to the infant carrier 12 in several different positions to add to the features and functionality of the infant carrier assembly 10. The bib 14 includes a pair of attachment tabs 54 and a bib panel 56, which may include a distal fastener 58.

Referring now specifically to FIG. 1, infant carrier 12 is shown in a facing-in configuration, with the bib 14 being disposed in a first bib configuration. The bib attachment tabs 54 are attached to bib attachment strips 59 located on the shoulder straps 18 to dispose the bib 14 between the infant and the wearer. In this regard, the bib 14 is used as a conventional bib to protect the wearer's clothing from fluids or objects which may fall out of the infant's mouth. The attachment tabs 54 and bib attachment strips 59 are cooperatively engageable with each other, and are preferably formed of hook and loop fastening material; however, other fasteners known by those skilled in the art may be used without departing from the spirit and scope of the present invention. The bib 14 may be deployed in the first bib configuration before or after the infant is placed within the carrier 12.

Figure 7:
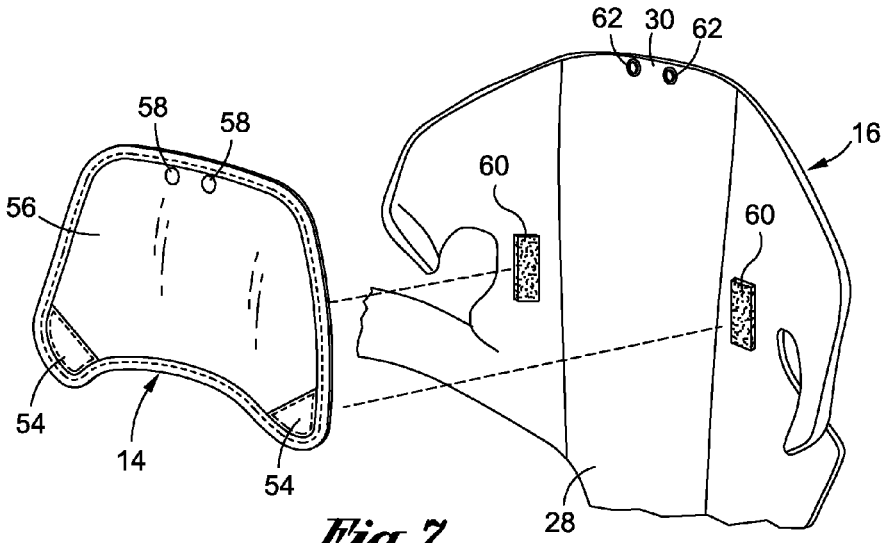
FIG. 7 is an exploded view of the bib and a section of the infant carrier, wherein the bib is in a second configuration for an infant seated in the infant carrier in a facing-out position.
Figure 8:
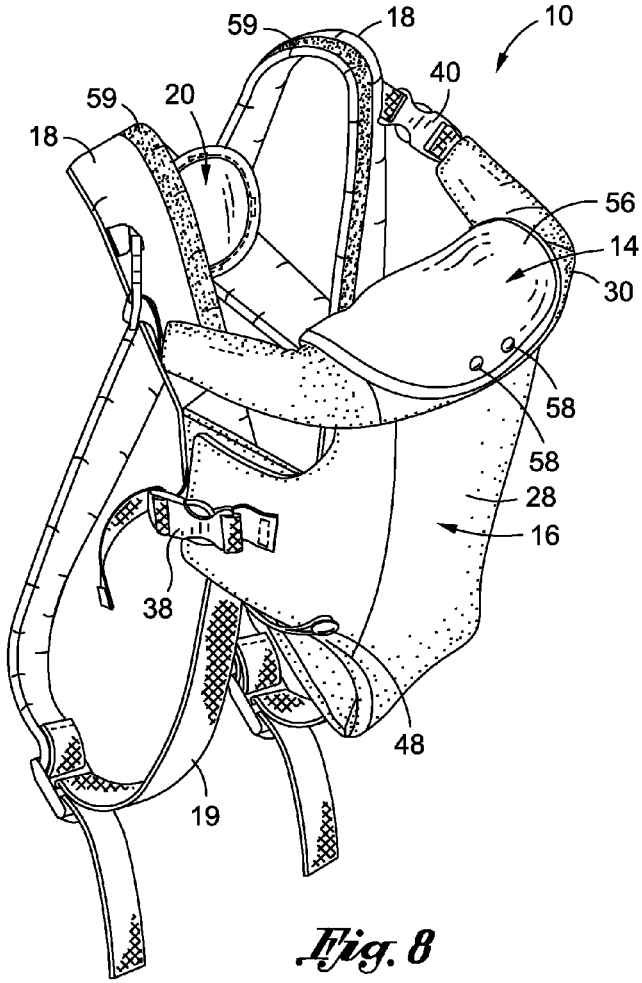
FIG. 8 is an upper perspective view of the infant carrier assembly with the bib in the second configuration.

Referring now to FIGS. 7-8, the infant carrier 12 is shown in a forward configuration to receive the infant in the facing-out position. In this configuration, the bib 14 is disposed in a second bib configuration with the attachment tabs 54 being connected to bib attachment strips 60 formed on the inner surface of the main panel 16. The bib panel 56 extends from the body portion 28 to the distal portion 30, with the distal fastener 58 being fastened to an attachment snap 62 formed on the distal portion 30. It is contemplated that certain embodiments may not include an attachment snap 62, in which case the distal end of the bib panel 56 simply hangs over the distal portion 30 of the main panel 16. In the second bib configuration, the bib 14 serves as a conventional bib, similar to the first bib configuration, to protect the infant carrier 12 from fluids or objects discharged from the infant's mouth. The bib 14 may be connected to the carrier 12 in the second bib configuration before or after the infant is placed within the carrier 12, and when the infant carrier 12 is in the facing-in position (as shown in FIG. 7, prior to being transitioned into the facing-out position), or in the facing-out position.

The attachment tabs 54 and attachment strips 60 are configured to be cooperatively engageable with each other, and are preferably formed of hook and loop fastening material, although other fasteners known in the art may also be used. Furthermore, the distal fastener 58 and attachment snap 62 preferably include complimentary snap-fasteners, but may comprise hook and lop fastening material or other fastening devices known in the art.

Figure 9:
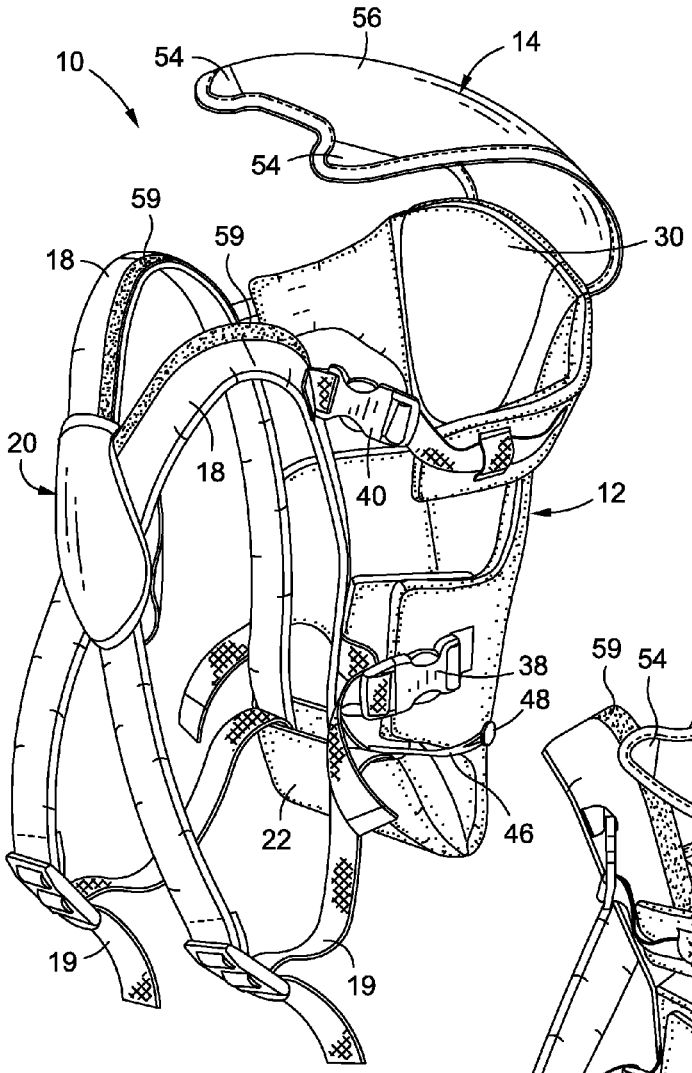
FIG. 9 is an upper perspective view of the infant carrier assembly with the bib partially deployed in a sun-shade configuration to provide shade to an infant seated in the infant carrier.
Figure 10:
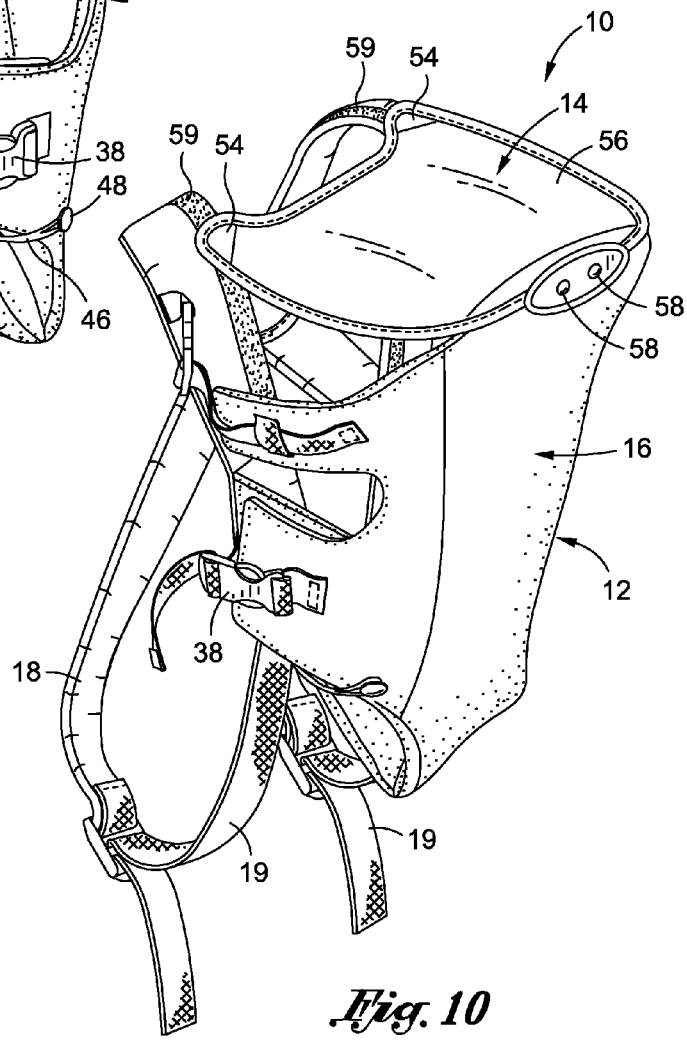
FIG. 10 is an upper perspective view of the infant carrier assembly with the bib completely deployed in the sun-shade configuration.

Turning to now to FIGS. 9 and 10, the bib 14 is shown in a third, sun visor configuration to provide shade for the infant disposed within the carrier 12. In the sun visor configuration, the attachment tabs 54 are connected to the bib attachment strips 59 disposed along the shoulder straps 18. The distal connector 58 is connected to the attachment snaps 62 to dispose the bib panel 56 over the carrier 12 to provide shade for the infant. When the bib 14 is in the sun visor configuration, the infant carrier 12 is preferably disposed in the facing-in position to extend the distal portion 30 of the main panel 16 above the infant's head to allow the bib 14 to extend over the infant to provide shade to the infant.

As set forth above, the bib 14 may advantageously provide three-in-one functionality to the infant carrier 12 to significantly enhance the experience of using the carrier 12 for the wearer, as well as the infant. In this regard, the bib 14 may be disposed in the first and second configurations to serve as a conventional bib to position the bib 14 adjacent the infant's mouth to collect fluids or objects discharged from the infant to protect the wearer's clothes, infant's clothes, as well as the infant carrier 12 fabric. The bib 14 may also be connected to the infant carrier 12 in a position to provide shade to the infant, which is critical given the sensitive nature of an infant's skin.

Although the foregoing discusses an infant carrier 12 and bib 14 disposable in three distinct positions, it is understood that various implementations of the infant carrier assembly 10 may include an infant carrier 12 and bib 14 configured to be disposable in only one or two of the above described configurations. For instance, one embodiment may include an infant carrier 12 and corresponding bib 14 configured to be disposable in the first bib configuration and the second bib configuration, but not the sun visor configuration. In this regard, the bib 14 may not include a distal connector 58 and the infant carrier 12 may not be outfitted with corresponding attachment snaps 62. However, such an infant carrier assembly 10 would nevertheless provide two-in-one functionality by including a bib 14 disposable in both the first bib configuration and the second bib configuration to accommodate an infant seated in a facing-in position or a facing-out position.

The bib 14 is preferably formed from a washable material to allow the wearer to simply remove the bib 14 from the carrier 12 when the bib 14 becomes dirty. In this regard, the wearer may have a number of bibs 14 on hand to easily swap one bib 14 for another when a bib 14 becomes dirty.

The bib 14 may also include a pattern, design or other indicia displayed thereon to enhance the aesthetic appeal of the carrier 12. Given that the bib 14 is prominently displayed in both the second bib configuration, as well as the sun visor configuration, various bibs 14 may be used to routinely change the overall appearance of the carrier assembly 10. Furthermore, different bibs 14 may be used to mark different occasions. For instance, a beach-themed bib 14 may be used if the wearer and infant are going to the beach, whereas a bib 14 having animals displayed thereon may be used if the wearer and infant are planning an outing to the zoo. It is further contemplated that the bib 14 may include patterns, logos, or other indicia corresponding to various holidays, such as fireworks/flags for the Fourth of July, snowmen for winter holidays, a cornucopia for Thanksgiving, etc. Furthermore, if the carrier 12 is used to carry an infant girl, a bib 14 including a pink color may be used, whereas, if the carrier 12 is used to carry an infant boy, a bib 14 including a blue color may be used. As such, the bib 14 allows a wearer to quickly and easily modify the overall appearance of the infant carrier assembly 10 to suit the particular tastes of the wearer or to mark a particular holiday or season.

Figure 11:
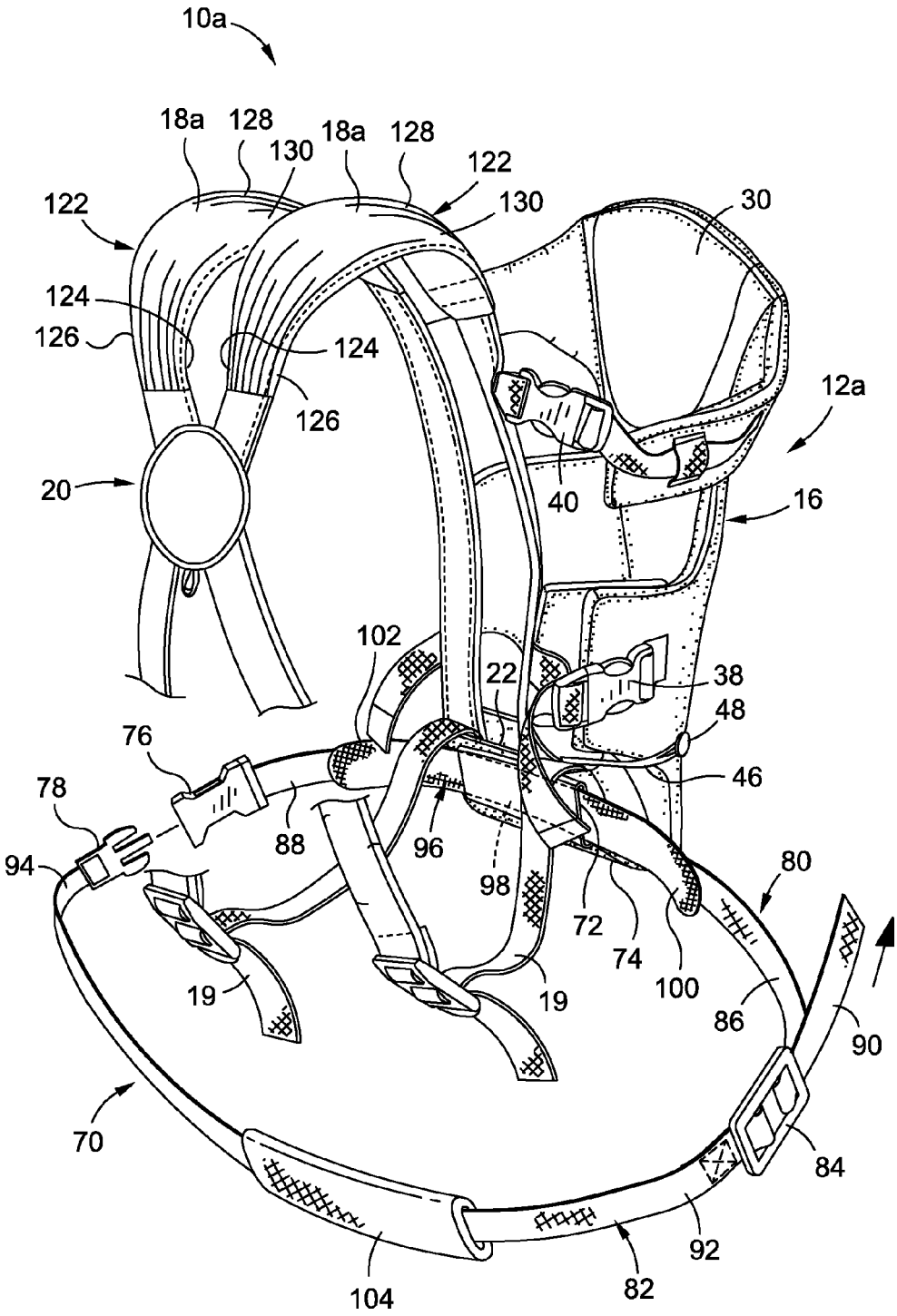
FIG. 11 is an upper perspective view of an alternative embodiment of the infant carrier assembly including a lumbar support belt.

Referring now to FIG. 11, there is shown another embodiment of the infant carrier assembly 10*a* that is specifically configured and adapted to be worn with the comfort and feel of a "wrap-type" infant carrier, while also benefiting from the security and ease of use associated with a conventional strap support system. The infant carrier assembly 10*a* is substantially similar in construction to the above-described infant carrier assembly 10. In this regard, only the structural distinctions between the infant carrier assemblies 10, 10*a* will be described with particularity below.

The infant carrier assembly 10*a* includes a removable lumbar support belt 70 which is worn around the wearer's abdomen and back to wrap around the wearer to provide a comfortable wrap-like feel to the user and to distribute the load on the wearer. The lumbar belt 70 is slidably disposed within a sleeve 72 formed on the infant carrier 12*a*. The infant carrier 12*a* includes a pocket body 74, which defines pocket 22 described above. The pocket body 74 is connected to the main panel 16 and is folded relative to the main panel 16 during use of the infant carrier assembly 10*a* to assume the configuration shown in FIG. 11. In the exemplary embodiment, the sleeve 72 includes a fabric panel connected to the pocket body 74 such that when the carrier assembly 10*a* is worn by the wearer, the sleeve 72 is disposed adjacent the wearer and lies generally flat against the wearer. When the infant carrier assembly 10*a* is worn in a front carry configuration, the sleeve 72 is positioned against the wearer's abdomen, and when the infant carrier assembly is worn in a back carry configuration, the sleeve 72 is positioned against the wearer's lower back. The sleeve 72 also extends in a longitudinal direction across the wearer's abdomen or back depending on whether the infant carrier assembly 10*a* is in the front carry or back carry configuration.

Although the exemplary embodiment shows the sleeve 72 as a separate fabric panel connected to the pocket body 74, it is contemplated that other embodiments may include a pocket body 74 with the sleeve 72 integrally formed therein. In particular, such embodiments may include an opening extending through the pocket body 74 from one lateral end of the pocket body 74 to the other lateral end of the pocket body 74 through which the lumbar belt 70 may extend.

The lumbar belt 70 includes a first connector end 76 and a second connector end 78 configured to be selectively engageable with each other to connect the lumbar belt 70 to the wearer. In the exemplary embodiment, the first and second connector ends 76, 78 are complimentary male and female fasteners, although other mechanical fasteners known in the art may also be used.

The lumbar belt 70 additionally includes a first segment 80 and a second segment 82 connected to each other by a length adjustable buckle 84. The first segment 80 includes a proximal end portion 86 and a distal end portion 88. The proximal end portion 86 is advanced through the length adjustable buckle 84 to define a slack portion 90, i.e., that portion of the first segment 80 that has been advanced through the length adjustable buckle 84. The distal end portion 88 of the first segment 80 is connected to the first connector end 76. Thus, the effective length of the first segment 80 is the distance between the length adjustable buckle 84 and the first connector end 76. The effective length of the first segment 80 may be decreased by increasing the length of the slack portion 90, and conversely, the effective length of the first segment 80 may be increased by decreasing the length of the slack portion 90.

The second segment 82 includes a proximal end portion 92 and a distal end portion 94. The proximal end portion 92 is connected to the length adjustable buckle 84 and the distal end portion 94 is connected to the second connector end 78.

A lumbar support pad 96 is connected to the lumbar belt 70 to enhance the comfort when worn by the user. The lumbar support pad 96 includes a generally straight middle portion 98 and opposed outer portions 100, 102. Stitching may be used to connect the lumbar support pad 96 to the lumbar belt 70, although it is also contemplated that the lumbar support pad 96 may be used without connecting it to the lumbar belt 70.

A tubular abdomen support sleeve 104 may be slidably disposed on the lumbar belt 70 to provide additional cushioning on the wearer's abdomen during use of the lumbar belt 70.

The abdomen support sleeve 104 may be slidably positioned on the lumbar belt 70 to fit the support sleeve 104 in proper position against the wearer.

In addition to the lumbar belt 70, the infant carrier assembly 10*a* also includes "wrap-like" shoulder straps 18*a* which are designed to create the feel of a "wrap-type" infant carrier. In this regard, the shoulder straps 18*a* do not include the padded layer included in shoulder straps 18 described above. Instead, each shoulder strap 18*a* defines a wider engagement portion which cups the user's shoulders and provides extensive coverage over the wearer's shoulders to efficiently distribute the load over the wearer. The significant coverage over the wearer's shoulders provides a soft natural feel which hugs the wearer when carrying the infant. Although the shoulder straps 18*a* provide the desirable feel of "wrap-like" shoulder straps, they are configured with the ease of use of conventional shoulder straps.

Figure 12:
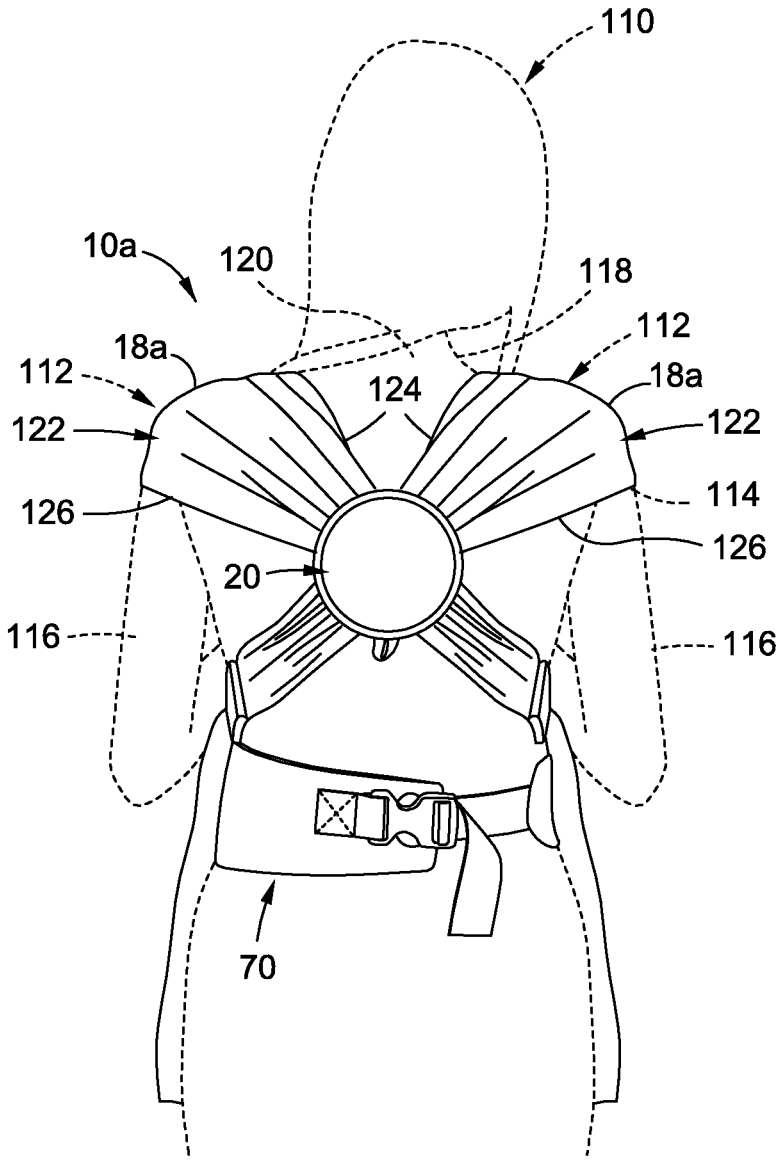
FIG. 12 is a rear view of the embodiment of the infant carrier assembly depicted in FIG. 11, the infant carrier assembly being shown on a wearer depicted in phantom.

Referring now specifically to FIG. 12, there is shown a rear view of a user 110 (shown in phantom) wearing the infant carrier assembly 10*a*. The user 110 has a pair of shoulders 112, wherein each shoulder 112 defines a distal shoulder portion 114, which interfaces with a respective one of the user's arms 116, and a medial shoulder portion 118 which interfaces with the user's neck 120. Each shoulder strap 18*a* includes a wide shoulder engagement segment 122 which extends in one direction over the wearer's shoulders 112 toward the wearer's neck 120, and in another direction partially over the top portion of the wearer's arm 116. When worn correctly, each shoulder support segment 122 includes a first lateral edge 124 that resides between the distal shoulder portion 114 and the wearer's neck 120, and a second lateral edge 126 that resides adjacent the wearer's arm 116.

The first and second lateral edges 124, 126 also emanate from the strap adjuster 20 toward the respective one of the wearer's shoulders 112 in non-parallel relation to each other. In this regard, the first and second lateral edges 124, 126 may be angled away from each other as they extend toward the top of the wearer's shoulder 112. As the first and second lateral edges 124, 126 pass over the wearer's shoulders 112, the first and second lateral edges 124, 126 may converge as they extend over the front of the wearer 110. The angle between the first and second lateral edges 124, 126 may be adjusted to fit the particular wearer 110. In this regard, for a wearer 110 with large, broad shoulders 112, the first and second lateral edges 124, 126 may be spread apart to define a large angle of divergence from the strap adjuster 20. Conversely, for a wearer 110 with smaller, narrower shoulders 112, the first and second lateral edges 124, 126 may be closer together to define a smaller angle of divergence from the strap adjuster 20.

The shoulder strap segments 122 may be specifically configured to be selectively opened, i.e., widened, as the shoulder strap segments 122 are placed on the wearer 110 to cup the wearer's shoulders 112. According to one embodiment, the shoulder strap segments 122 include a pair of pleats 128, 130. The pleats 128, 130 preferably extend in a longitudinal direction from an end of the shoulder strap segment 122 to allow for latitudinal expansion or contraction of the shoulder strap segment 122. More specifically, the pleats 128, 130 allow each shoulder strap segment 122 to move between a completely open position, wherein the pleats 128, 130 are farthest apart from each other to maximize the width of the shoulder strap segment 122, and a closed position, wherein the pleats 128, 130 are substantially touching each other along their length to cover material extending between the pleats 128, 130. Although the foregoing describes each shoulder strap segment 122 as including a pair of pleats 128, 130, it is understood that any number of pleats may be incorporated into the design of the shoulder strap segment 122.

Those skilled in the art will readily appreciate that the location and/or orientation of the hardware used to connect the shoulder straps 18*a* to the main panel 12*a* may be modified to accommodate the specific configuration and loads transferred between by the shoulder straps 18*a* and the main panel 12*a*.

This disclosure provides an exemplary embodiment of the present invention. The scope of the present invention is not limited by this exemplary embodiment. Numerous variations, whether explicitly provided for by the specification or implied by the specification, such as variations in structure, dimension, type of material and manufacturing process may be implemented by one of skill in the art in view of this disclosure.

What is claimed is:

1. An infant carrier assembly for carrying an infant, the infant carrier assembly comprising:

an infant carrier including:

a pair of shoulder straps, each shoulder strap having a shoulder engagement segment configured to be positionable adjacent a respective one of the wearer's shoulders to cup the respective one of the wearer's shoulders;

a main panel having a body portion and a distal portion, the main panel being engageable with the pair of shoulder straps to define a pair of leg openings to receive and support the infant, within the infant carrier, the main panel being transitional between a rearward configuration wherein the distal portion is substantially coplanar with the body portion and a forward configuration wherein the distal portion is folded relative to the body portion to overlap the body portion; and a lumbar belt connected to the main body, the lumbar belt having a first connector end and a second connector end engageable to each other to maintain a looped configuration about the abdomen and back of the wearer; and a bib having a pair of attachment tabs and a bib panel connected to the pair of attachment tabs, the pair of attachment tabs being configured to be releasably attachable to the infant carrier in a first bib configuration when the infant carrier is in the rearward configuration to dispose the bib panel between the pair of shoulder straps, and a second bib configuration when the infant carrier is in the forward position to dispose the bib panel adjacent the main panel;

the bib being configured to be attachable to the infant carrier to assume is sun visor configuration, wherein the pair of attachment tabs are connected to respective ones of the pair of shoulder straps, and the bib panel is attached to the main panel.

2. The infant carrier assembly of claim 1, further comprising:

a lumbar support pad affixed to the lumbar belt and being slidable relative to the main panel.

3. The infant carrier assembly of claim 2, wherein the lumbar support pad includes a straight middle portion, and opposed outer portions angled relative to the middle portion to conform to the back of the wearer.

4. The infant carrier assembly of claim 2, wherein the lumbar belt is defined by a first segment to which the lumbar support pad is affixed, and a second segment having a first end coupled to the first segment with a threaded adjustable buckle and a second end coupled to the first segment with a locking connector.

5. The infant carrier assembly of claim 4, further comprising:

a tubular abdomen support sleeve selectively positionable along the second segment of the support belt between the first end and the second end thereof.

6. The infant carrier assembly of claim 1, wherein the first connector end and the second connector end are complimentary male and female fasteners.

7. The infant carrier assembly of claim 1, wherein each shoulder engagement segment includes opposed first and second lateral edges, the distance between the first and second lateral edges varying along the shoulder engagement segment.

8. The infant carrier assembly of claim 1, wherein the bib panel extends from the body portion to the distal portion when the bib is in the second bib configuration.

9. The infant carrier assembly of claim 8, wherein the pair of attachment tabs are connected to prescribed locations of the body portion when the bib is in the second bib configuration.

10. The infant carrier assembly of claim 9, wherein the bib panel is connected to a prescribed location of the distal portion when the bib is in the second bib configuration.

11. The infant carrier assembly of claim 1, wherein the bib is connected to the infant carrier in the sun visor configuration when the infant carrier is in the rearward configuration.

12. The infant carrier assembly of claim 1, wherein the bib panel includes a distal portion connected to the distal portion of the main panel when the bib is in the sun visor configuration.

13. The infant carrier assembly of claim 1, further comprising a pair of fasteners configured to engage the distal portion to the pair of shoulder straps to dispose the distal portion in the rearward configuration and to disengage the distal portion from the pair of should straps to dispose the distal portion in the forward configuration.

14. The infant carrier assembly of claim 1, wherein the pair of shoulder straps are connected to the main panel to assume an overlapping, intersecting configuration to define an intersection point.

15. The infant carrier assembly of claim 14, further comprising a strap connector slidably coupled to the pair of shoulder straps, the strap connector being slidable along the pair of shoulder straps to move the intersection point along the pair of shoulder straps.

16. The infant carrier assembly of claim 15, wherein each shoulder engagement segment includes opposed first and second lateral edges, the first and second lateral edges diverging as they extend away from the strap connector toward the user's shoulder.

17. The infant carrier assembly of claim 1, further including a pair of strap fasteners for engaging the pair of shoulder straps to the main panel, the infant carrier further comprising a pocket coupled to the main panel, the pocket being sized and configured to capture the pair of strap fasteners.

* * * * *